US007432861B2

(12) United States Patent
Shih

(10) Patent No.: US 7,432,861 B2
(45) Date of Patent: Oct. 7, 2008

(54) DUAL-BAND ANTENNA

(75) Inventor: Yen-Yi Shih, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/560,859

(22) Filed: Nov. 17, 2006

(65) Prior Publication Data

US 2007/0247369 A1 Oct. 25, 2007

(30) Foreign Application Priority Data

Apr. 21, 2006 (TW) ..... 95114366 A

(51) Int. Cl.
*H01Q 1/38* (2006.01)

(52) U.S. Cl. ..... 343/700 MS; 343/846; 343/767; 343/770

(58) Field of Classification Search ..... 343/700 MS, 343/846, 767, 770
See application file for complete search history.

(56) References Cited

U.S. PATENT DOCUMENTS 6,140,966 A * 10/2000 Pankinaho ..... 343/700 MS
6,861,988 B2 3/2005 Gabriel et al.
6,906,678 B2 * 6/2005 Chen ..... 343/795

* cited by examiner

*Primary Examiner*—Hoang V Nguyen
(74) *Attorney, Agent, or Firm*—Wei Te Chung

(57) ABSTRACT

A dual-band antenna (10) is provided. The dual-band antenna printed on a substrate (30) includes a transmission portion (120), a first radiator (140), a second radiator (160), a first grounded portion (180), and a second grounded portion (190). The transmission portion is used for feeding electromagnetic signals. The first radiator is electronically connected to the transmission portion for transceiving electromagnetic signals with a first frequency. The second radiator is electronically connected to the transmission portion for transceiving electromagnetic signals with a second frequency. The first grounded portion is disposed on a first surface of the substrate. The second grounded portion is disposed on a second surface of the substrate. A length of the second grounded portion is greater than that of the first grounded portion. An antenna assembly is also provided in the present invention.

20 Claims, 13 Drawing Sheets

DUAL-BAND ANTENNA

BACKGROUND OF THE INVENTION

1. Field of the Invention

The present invention relates to antennas in wireless communication, and more particularly to a dual-band antenna.

2. Description of Related Art

A dual-band antenna is a necessary component for network devices operating according to the IEEE 802.16 standard, such as an access point or a wireless router. At present, there are two operating frequencies, which comply with the IEEE 802.16 standard, one is 2.5 GHz, and the other is 3.5 GHz. Some manufacturers in the art use a waveguide element, such as a microstrip, to act as an antenna for radiating wireless signals. The microstrip is conventionally formed on a printed circuit board for transceiving electromagnetic signals, and is configured for working with only one operating frequency.

Therefore, a need exists in the industry for an antenna that can be used for both operating frequencies, which comply with the IEEE 802.16 standard.

SUMMARY OF THE INVENTION

One aspect of the present invention provides a dual-band antenna. The dual-band antenna is printed on a substrate, and includes a transmission portion, a first radiator, a second radiator, a first grounded portion, and a second grounded portion. The transmission portion is used for feeding the electromagnetic signals. The first radiator is electronically connected to the transmission portion for transceiving electromagnetic signals with a first frequency. The second radiator is electronically connected to the transmission portion for transceiving electromagnetic signals with a second frequency. The first grounded portion is disposed on a first surface of the substrate. The second grounded portion is disposed on a second surface of the substrate. A length of the second grounded portion is greater than that of the first grounded portion.

Advantageously, another aspect of the present invention provides an antenna assembly.

Other objectives, advantages and novel features of the present invention will be drawn from the following detailed description of preferred embodiments of the present invention with the attached drawings, in which:

DETAILED DESCRIPTION OF THE INVENTION

Figure 1:
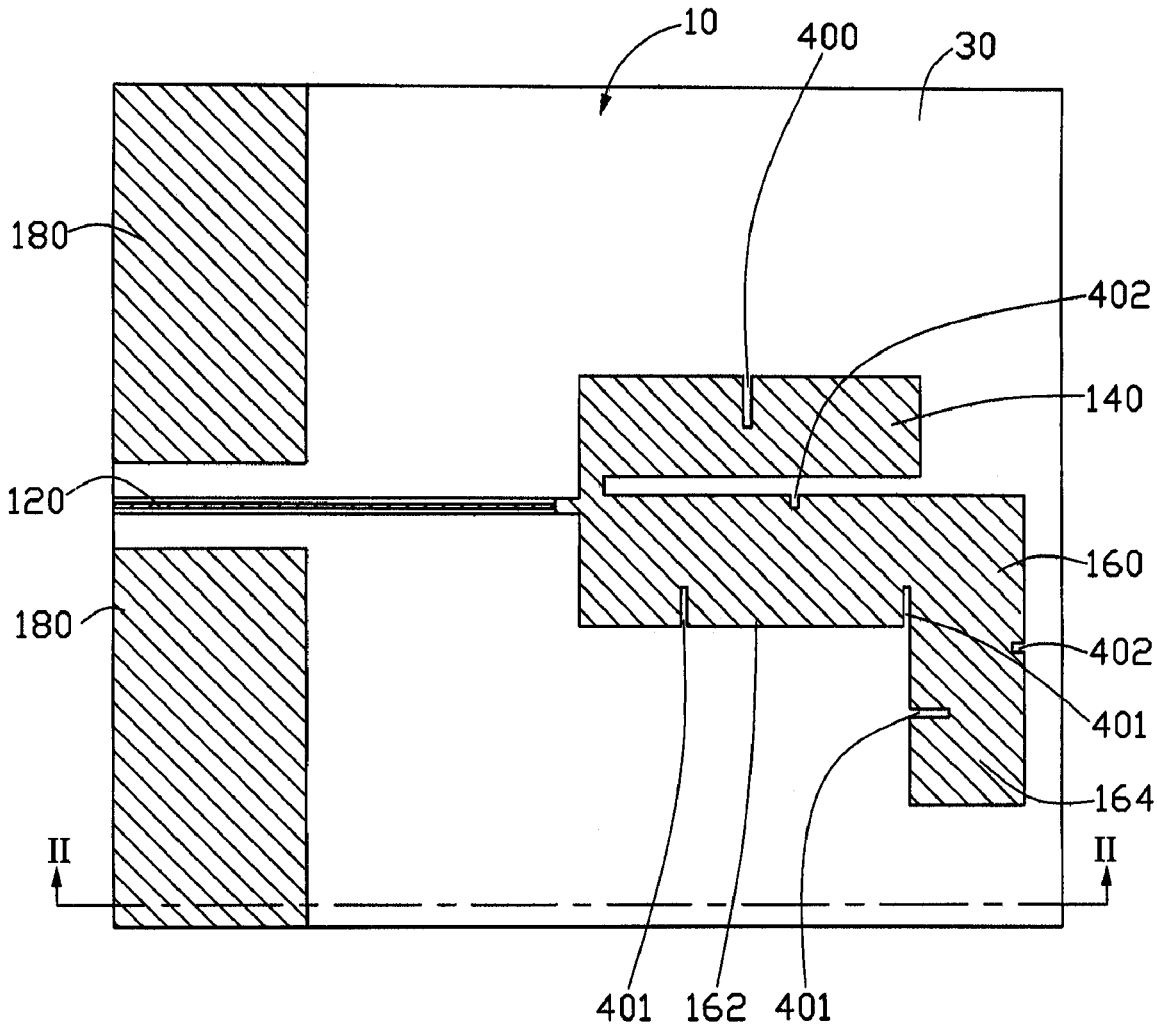
FIG. 1 is a top plan view of a dual-band antenna in accordance with an exemplary embodiment of the present invention.

FIG. 1 is a top plan view of a dual-band antenna 10 in accordance with an exemplary embodiment of the present invention.

Figure 2:
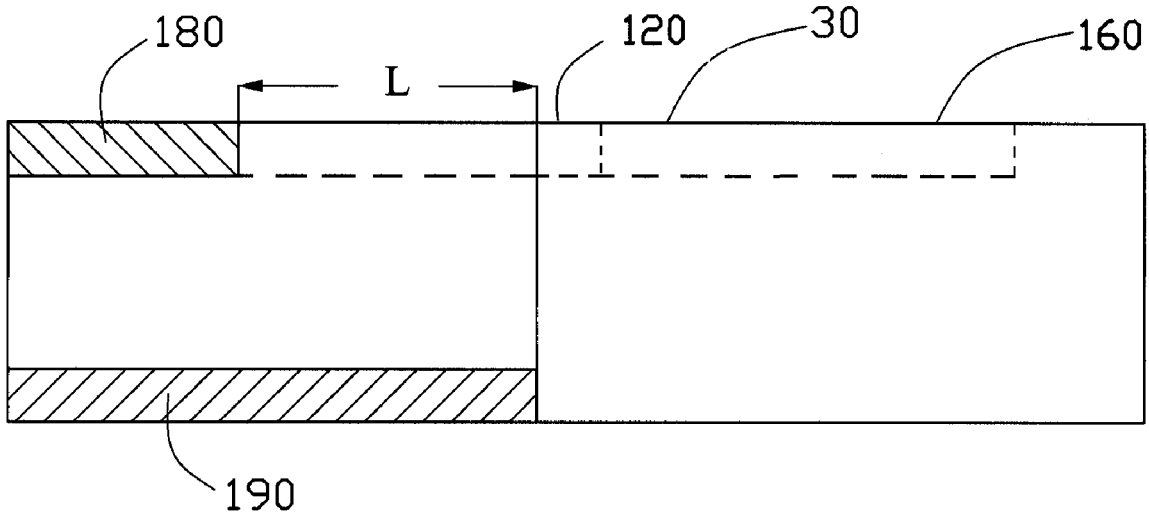
FIG. 2 is a II-II section view of the dual-band antenna of FIG. 1.

The dual-band antenna 10 is printed on a substrate 30, for transceiving electromagnetic signals. The dual-band antenna 10 includes a transmission portion 120, a first radiator 140, a second radiator 160, a first grounded portion 180, and a second grounded portion 190 as shown in FIG. 2.

The transmission portion 120 is disposed on a first surface of the substrate 30 for feeding the electromagnetic signals. The first grounded portion 180 is also disposed on the first surface of the substrate 30, alongside of the transmission portion 120.

The first radiator 140 is used for transceiving electromagnetic signals with a first frequency, such as signals with frequency of 3.5 GHz. The first radiator 140 is disposed on the first surface of the substrate 30, and is electronically connected to one end of the transmission portion 120. The first radiator 140 includes a notch 400. In this embodiment, the notch 400 is in rectangular-shaped. Advantageously, the first radiator 140 can also include multiple notches 400 therein for reducing the length thereof.

The second radiator 160 is used for transceiving electromagnetic signals with a second frequency, such as signals with frequency of 2.5 GHz. A length of the second radiator 160 is greater than that of the first radiator 140. Therefore, the first radiator 140 operates at a higher frequency than that of the second radiator 160. The second radiator 160 is disposed on a second surface of the substrate 30, and is electronically connected to the transmission portion 120. The second radiator 160 includes a first radiating portion 162 and a second radiating portion 164.

The first radiating portion 162 is electronically connected to the one end of the transmission portion 120 same as the first radiator 140, and extends parallel to the first radiator 140. The second radiating portion 164 is connected to one end of the first radiating portion 162, and is vertical to the first radiating portion 162. The first and second radiators 140, 160 extend side by side along an extension direction away from the one end of the transmission portion and closely neighbor each other along the extension direction.

Advantageously, the second radiator 160 includes a plurality of notches 401 and 402, which are used to make the second radiator 160 be in a "S" shape, and substantially changing the effective transmission path of the second radiator 160, which can change the frequencies of signals transmitted by the second radiator 160. That is, if a total length of the first radiating portion 162 and the second radiating portion 164 is fixed, radiating frequencies of the second radiator 160 can be changed by adding or reducing the quantity of the notches 401 and 402.

In this exemplary embodiment, a length of the notch 400 is less than half a width of the first radiator 140. A sum of the lengths of the notches 401 and the notches 402 is less than half a width of the second radiator 160. The notches 400, 401, and 402 disposed in the first radiator 140 and the second radiator 160 are used for changing the lengths of the transmission paths thereof, for accommodating frequencies complying with IEEE 802.16.

FIG. 2 is a II-II section view of the dual-band antenna 10 of FIG. 1.

The second grounded portion 190 is disposed on a second surface of the substrate 30. A length of the second grounded portion 190 is L mm greater than that of the first grounded portion 180 along the transmission portion 120, with the effect of broadening operating frequency of the dual-band antenna 10, and reducing interference generated among the transmission portion 120, the first radiator 140, and the second radiator 160.

In the present embodiment, a length and a width of the transmission portion 120 are respectively 20 mm and 0.28 mm. A length and a width of the first radiator 140 are respectively 13.7 mm and 4.03 mm. A length and a width of the notch 400 are respectively 2.03 mm and 0.3 mm. A length and a width of each notch 401 are respectively 1.5 mm and 0.3 mm. A length and a width of each notch 402 are respectively 0.5 mm and 0.3 mm. A length and a width of the first radiating portion 162 are respectively 18.23 mm and 4.53 mm. A length and a width of the second radiating portion 164 are respectively 7.16 mm and 4.53 mm. L is substantially equal to 10 mm, which is equal to an eighth of the wavelength of the operating frequency.

Figure 3:
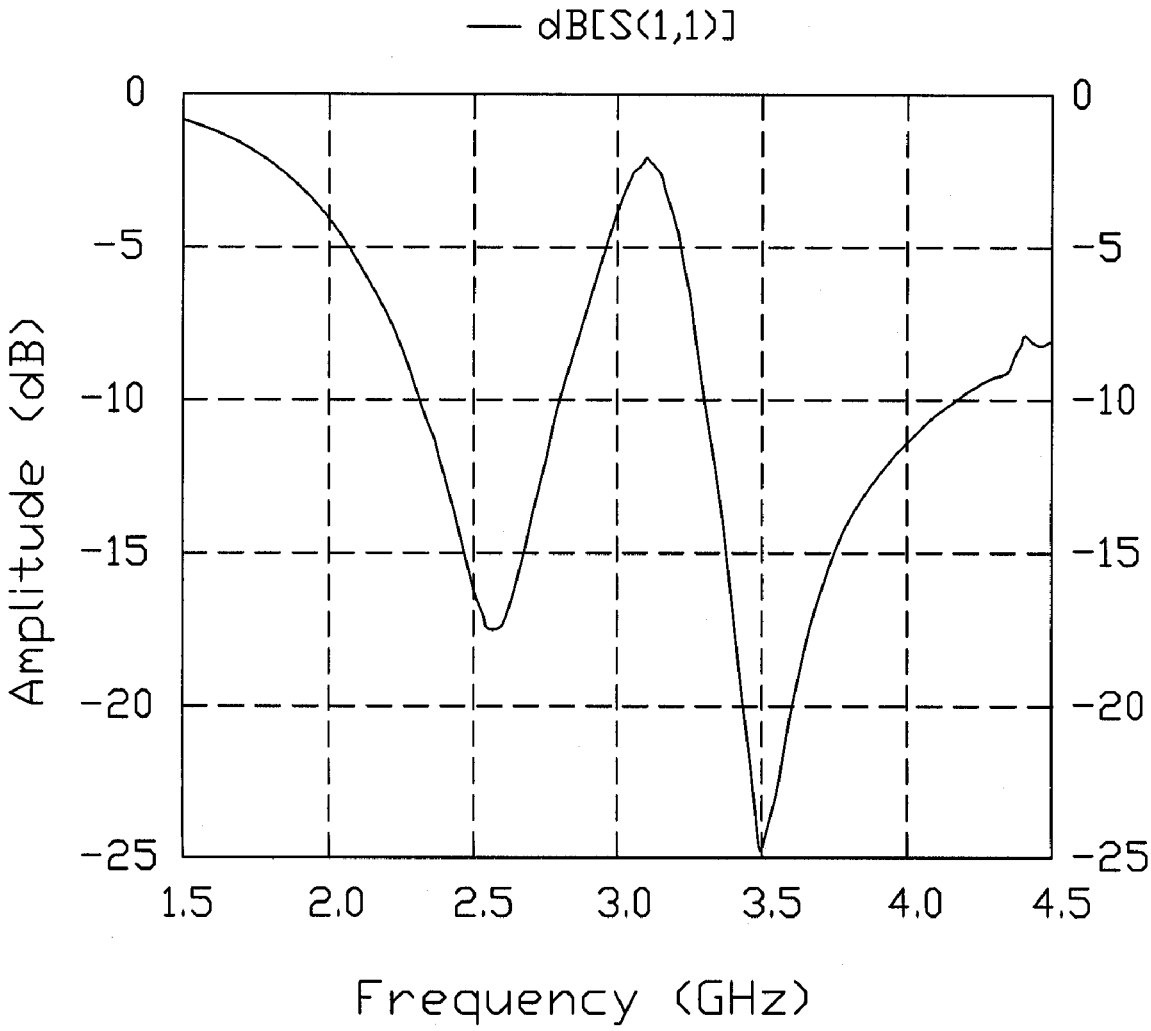
FIG. 3 is a graph showing return loss of the dual-band antenna of FIG. 1.
Figure 4:
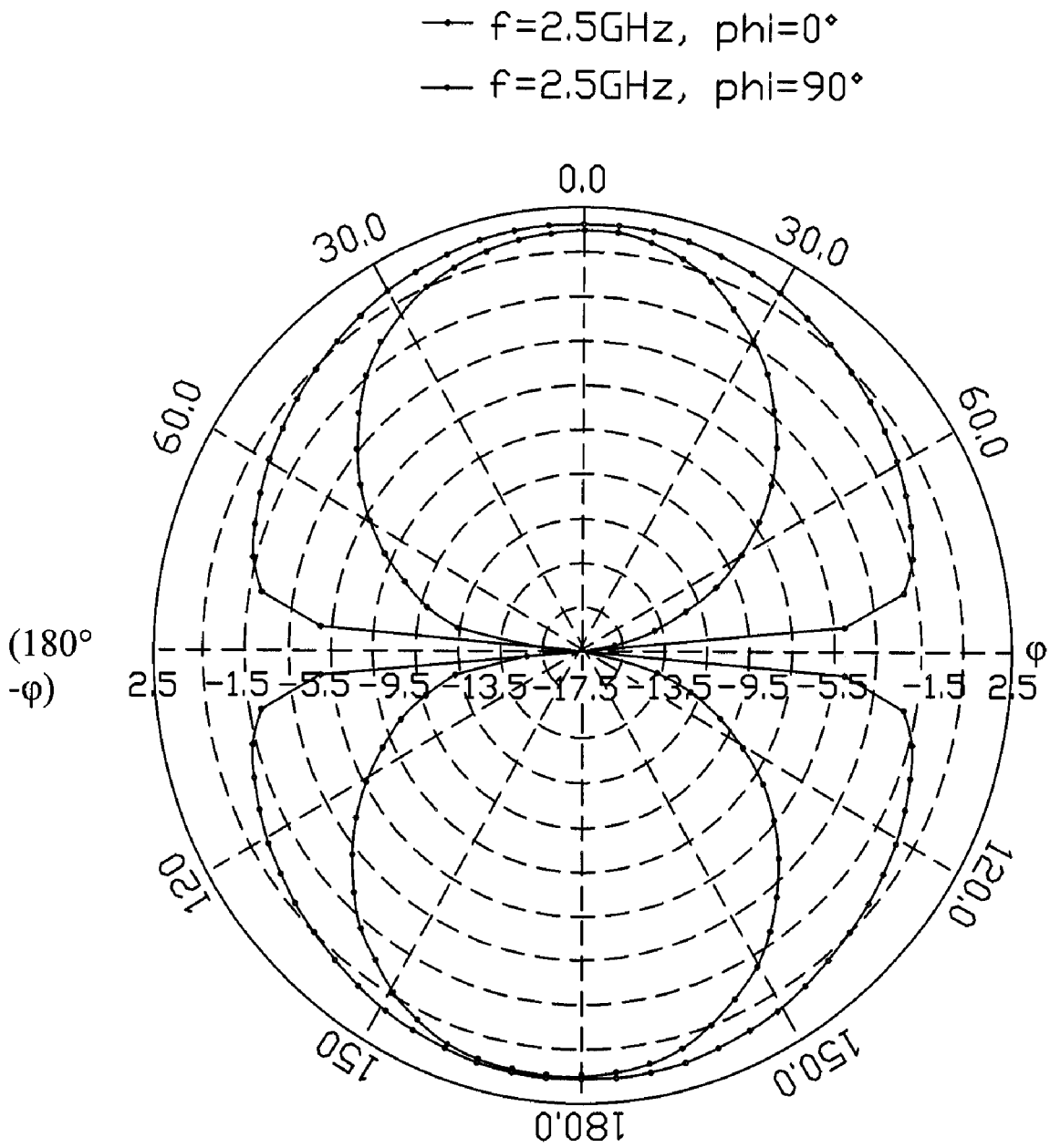
FIG. 4 through FIG. 7 are test charts showing radiation patterns when the dual-band antenna of FIG. 1 operates at frequencies of 2.5 GHz and 3.5 GHz in compliance with IEEE 802.16 standard.
Figure 5:
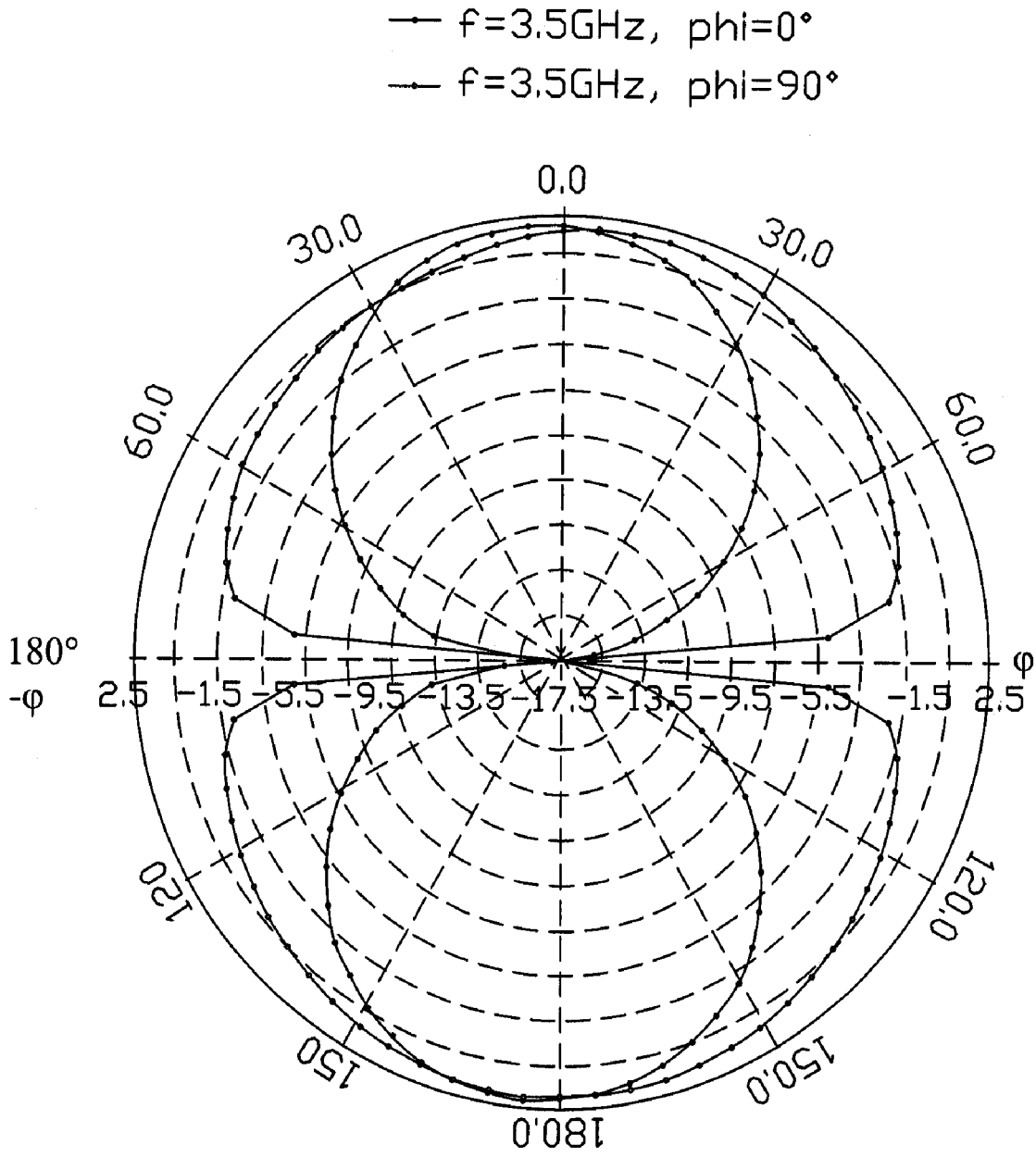
Figure 6:
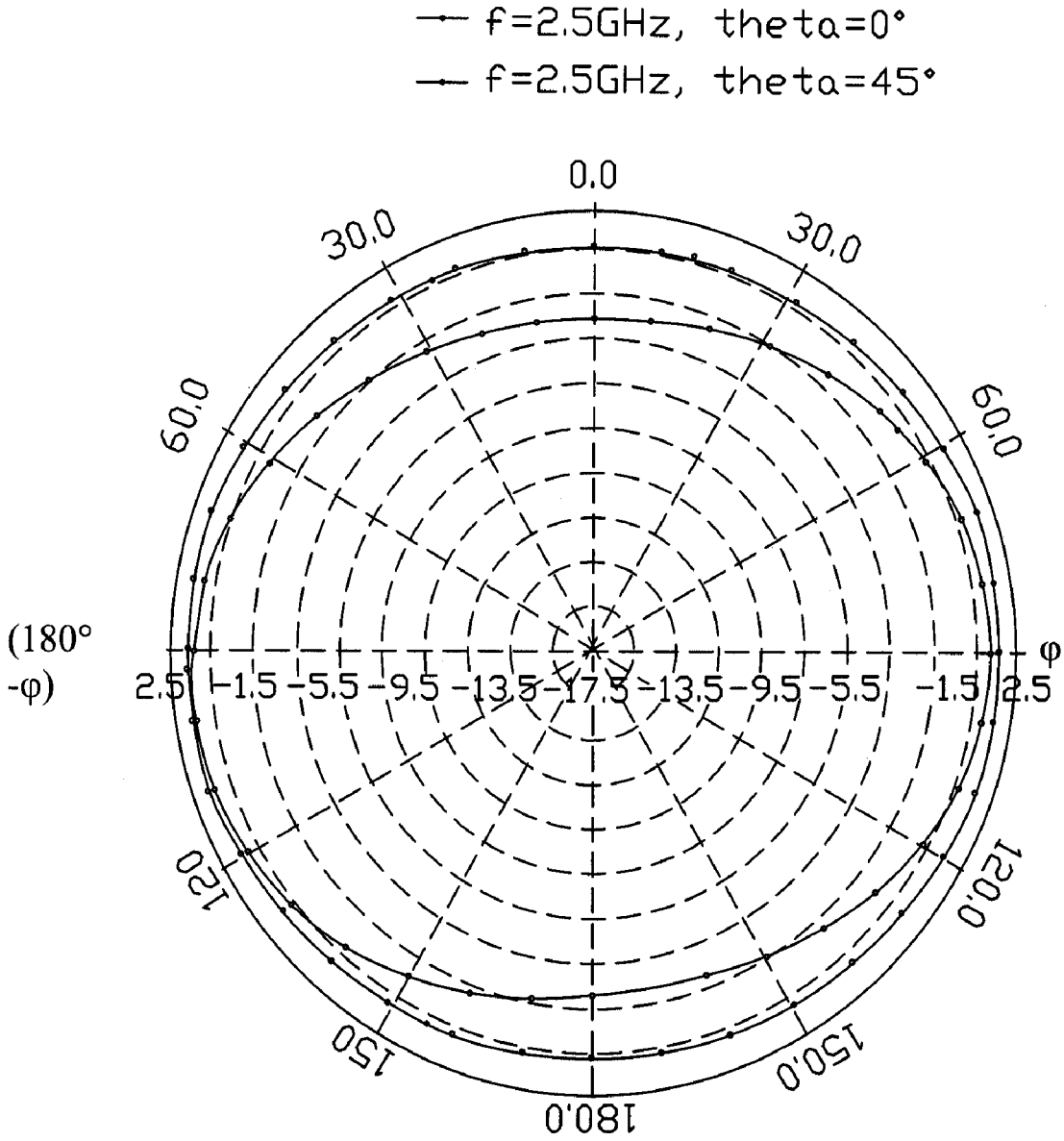
Figure 7:
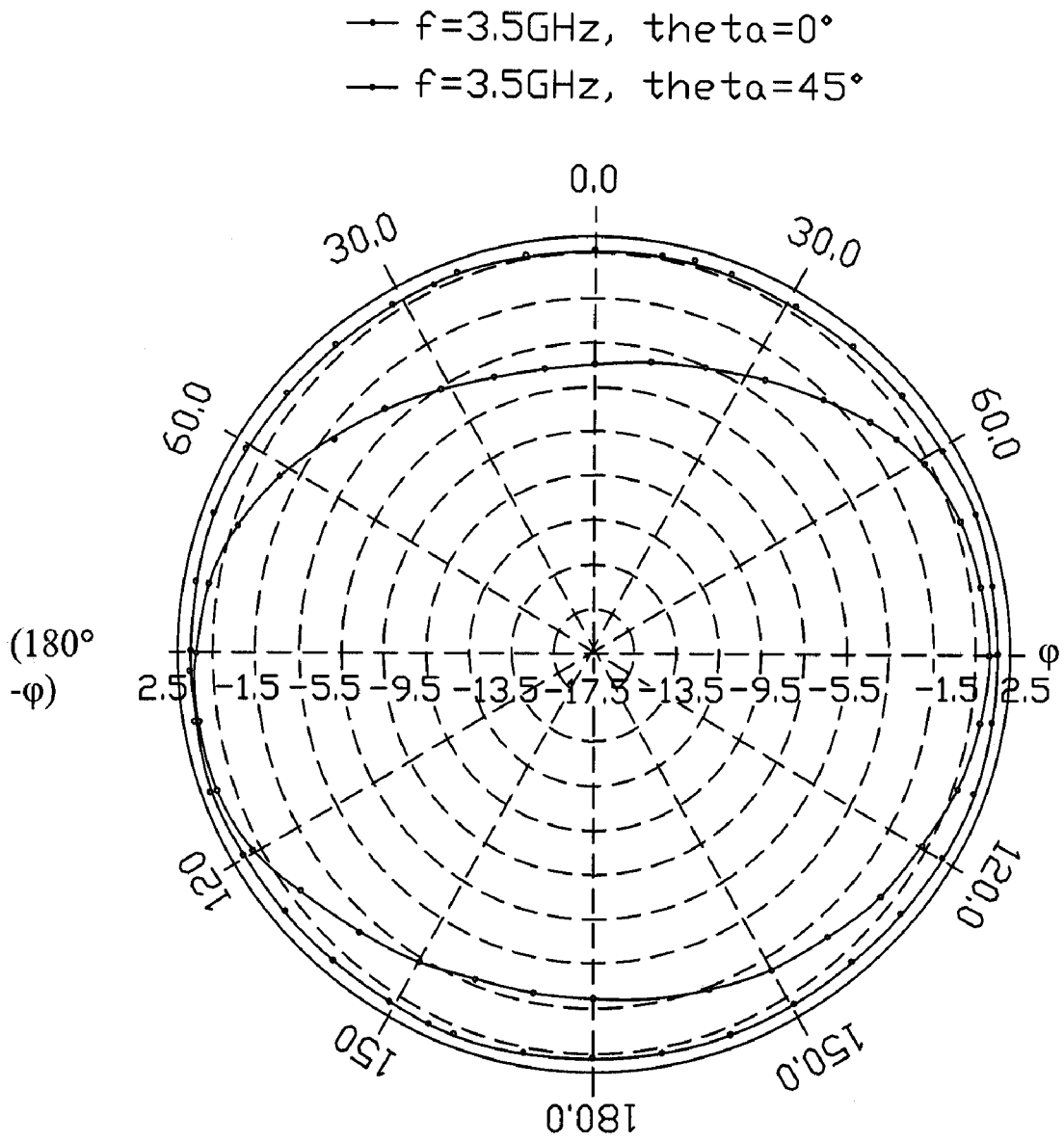

FIG. 3 is a graph showing return loss of the dual-band antenna 10.

As shown in FIG. 3, when the dual-band antenna 10 operates at frequencies of 2.5 GHz and 3.5 GHz of IEEE 802.16 standard, the return loss of the dual-band antenna 10 is less than −10 dB.

FIG. 4 through FIG. 7 are test charts showing radiation patterns when the dual-band antenna 10 operates at frequencies of 2.5 GHz and 3.5 GHz in compliance with IEEE 802.16 standard.

As shown in FIG. 4 through FIG. 7, when the dual-band antenna 10 operates at frequencies of 2.5 GHz and 3.5 GHz, all of the radiation patterns of the dual-band antenna 10 are substantially omni-directional.

Figure 8:
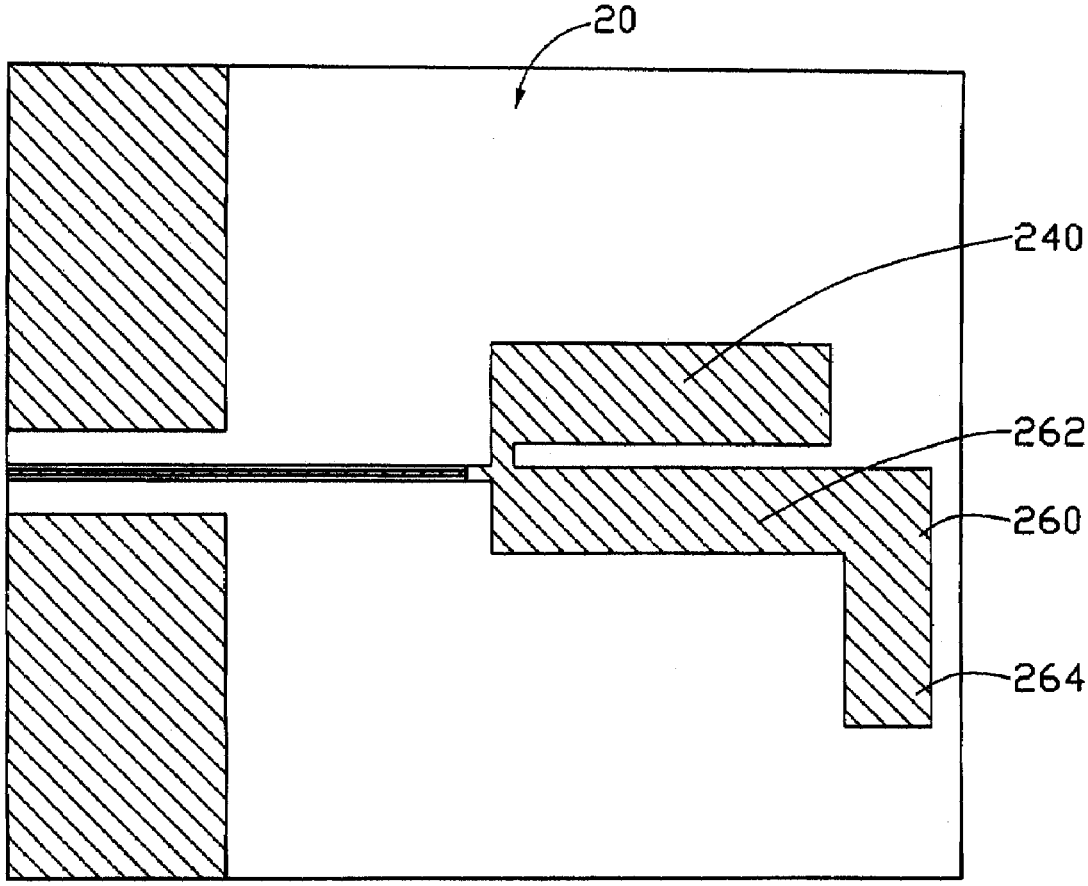
FIG. 8 is a top plan view of a dual-band antenna in accordance with another exemplary embodiment of the present invention.

FIG. 8 is a top plan view of a dual-band antenna 20 in accordance with another exemplary embodiment of the present invention.

In this exemplary embodiment, no notch is employed by the first radiator 240 and the second radiator 260 of the dual-band antenna 20. Other elements of the dual-band antenna 20 and configuration thereof are same as that of the dual-band antenna 10.

A length and a width of the first radiator 240 are respectively 13.9 mm and 4.03 mm. A length and a width of the first radiating portion 262 are respectively 18.0 mm and 3.53 mm. A length and a width of the second radiating portion 164 are respectively 7.0 mm and 4.53 mm. Sizes of other elements of the dual-band antenna 20 are same as that of the dual-band antenna 10.

Figure 9:
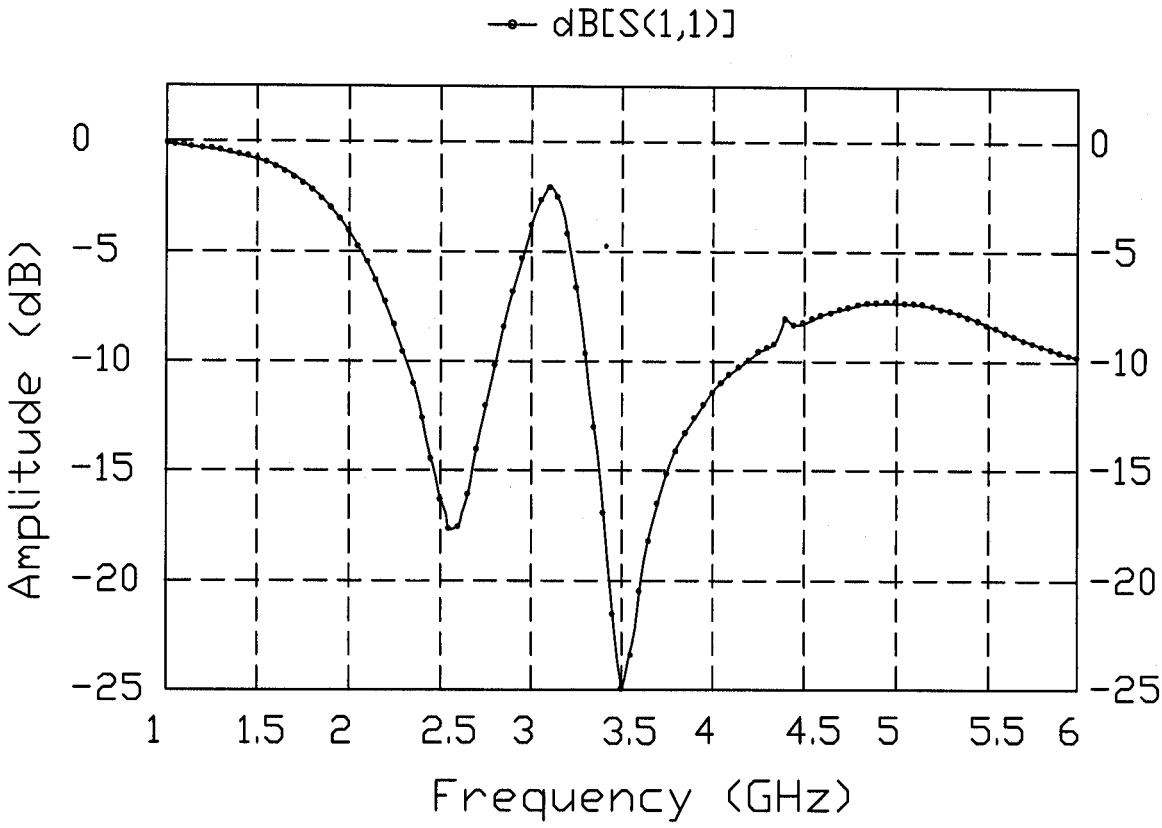
FIG. 9 is a graph showing return loss of the dual-band antenna of FIG. 8.
Figure 10:
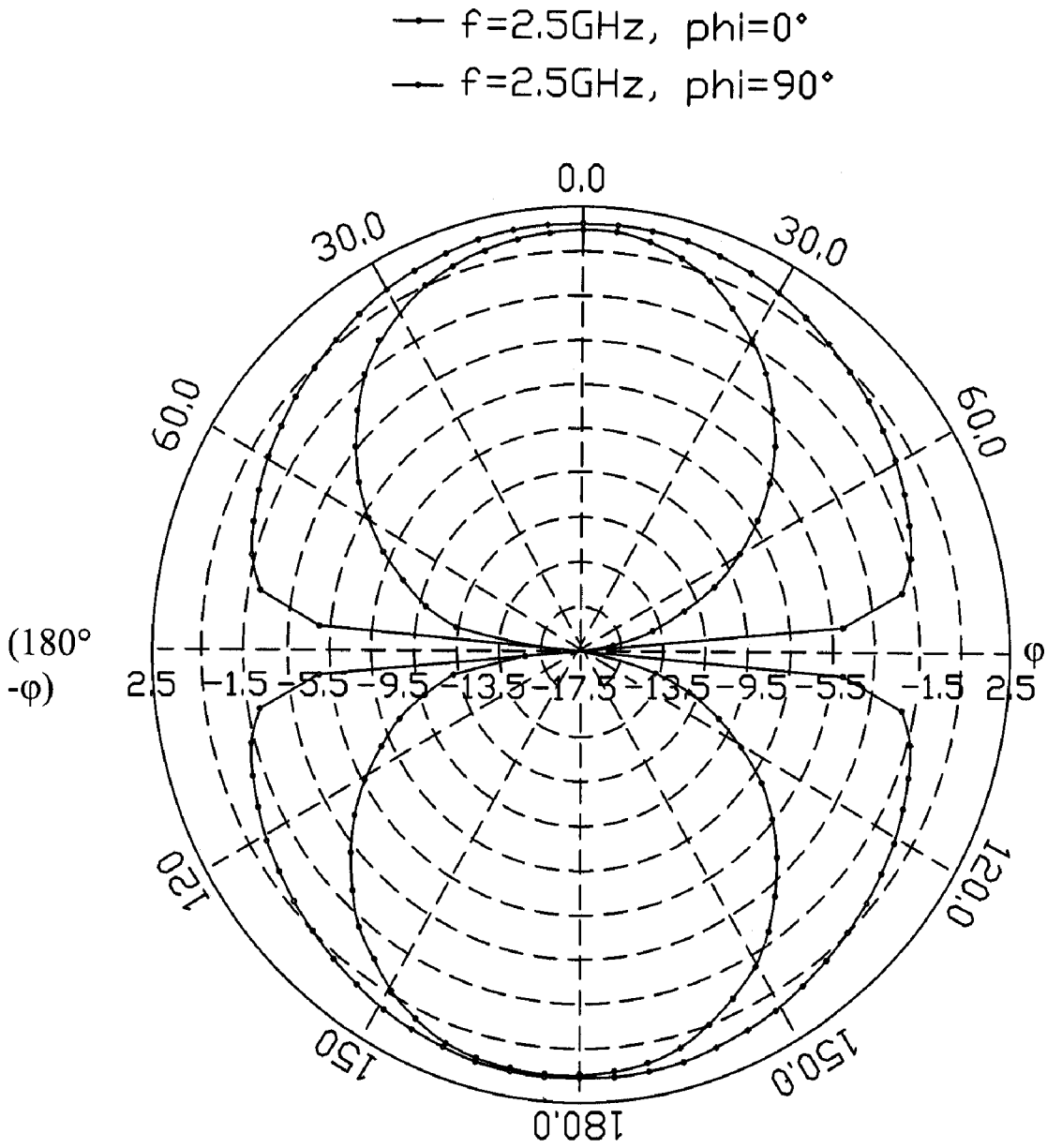
FIG. 10 through FIG. 13 are test charts showing radiation patterns when the dual-band antenna of FIG. 8 operates at frequencies of 2.5 GHz and 3.5 GHz in compliance with IEEE 802.16 standard.
Figure 11:
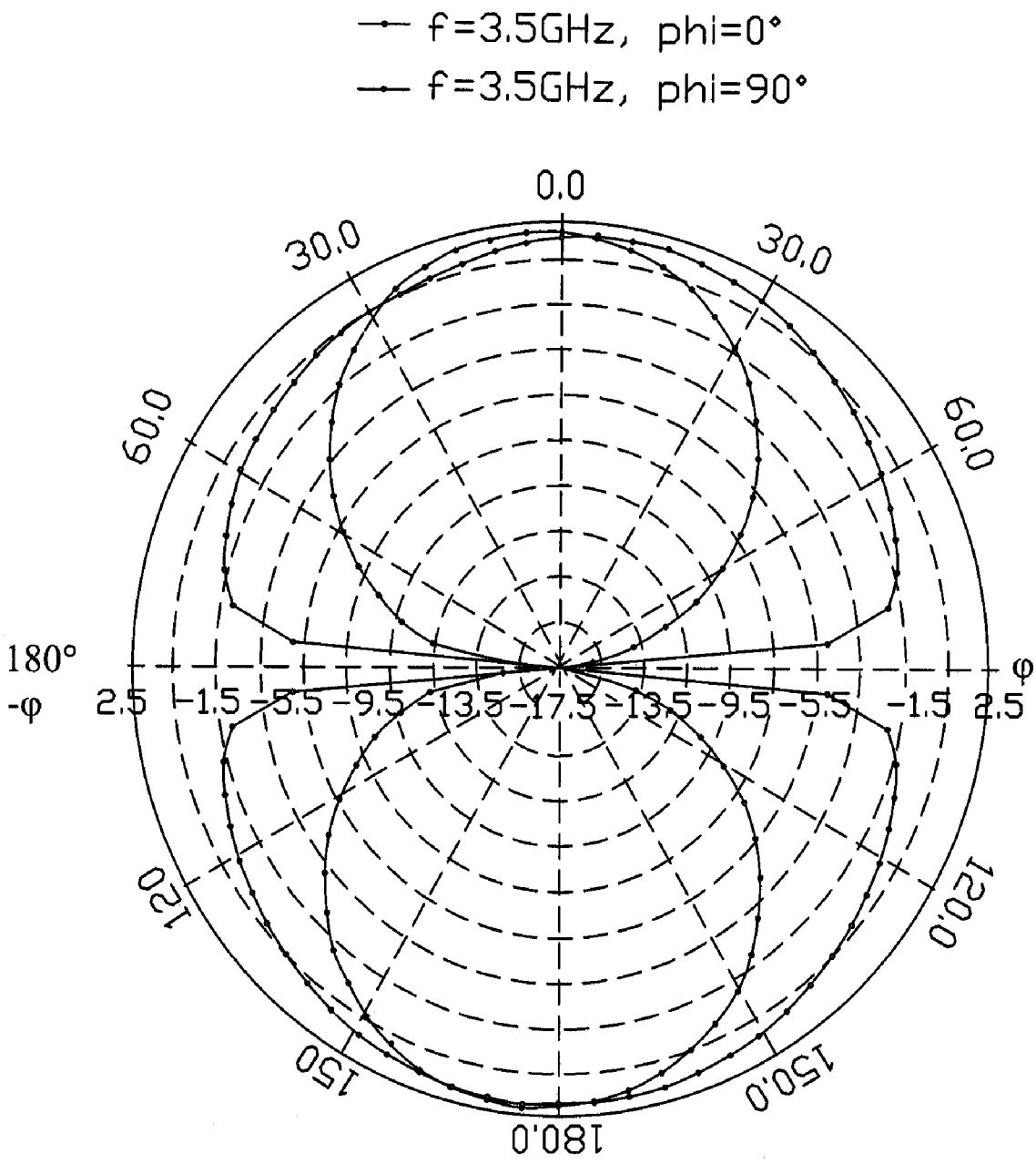
Figure 12:
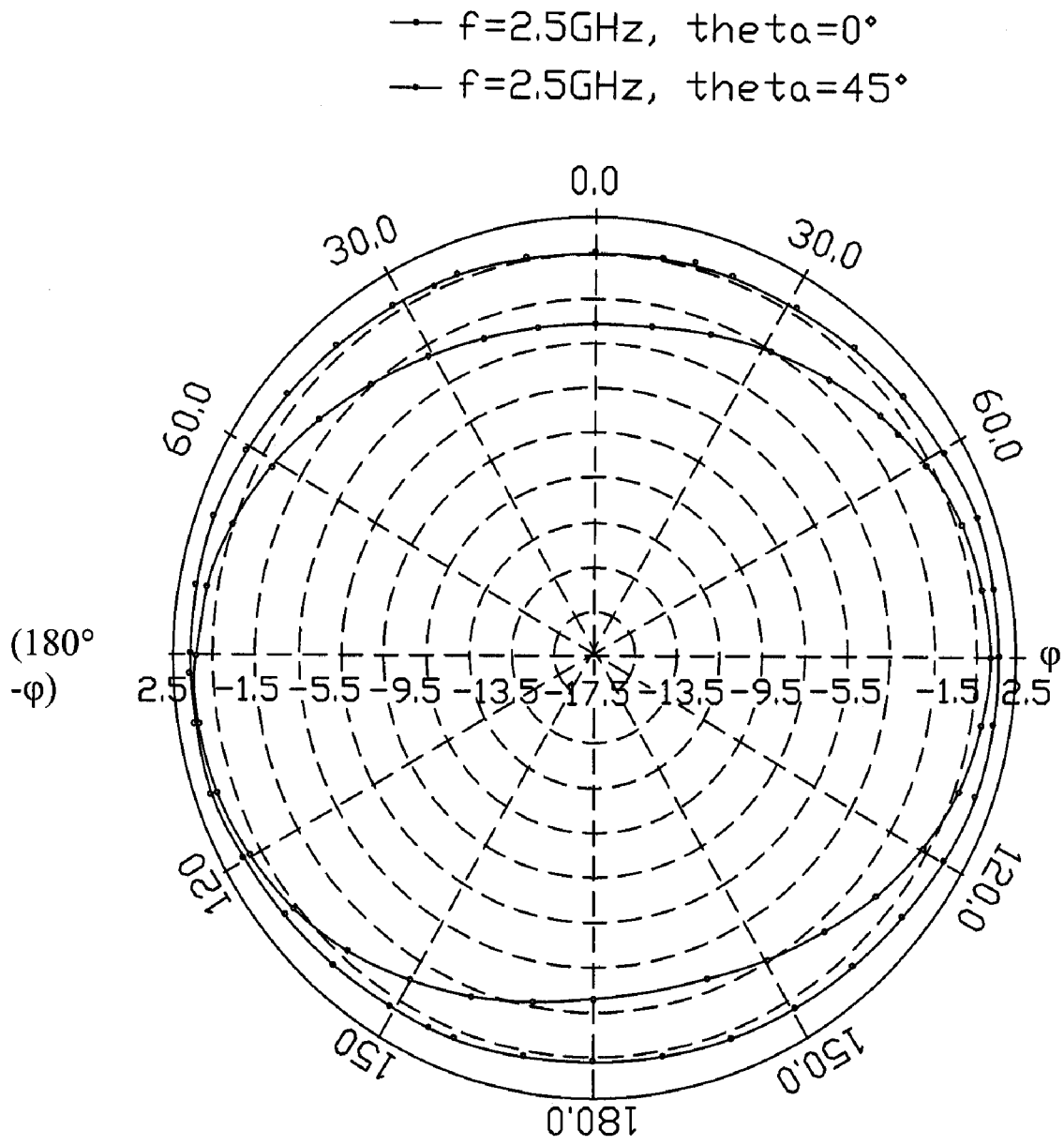
Figure 13:
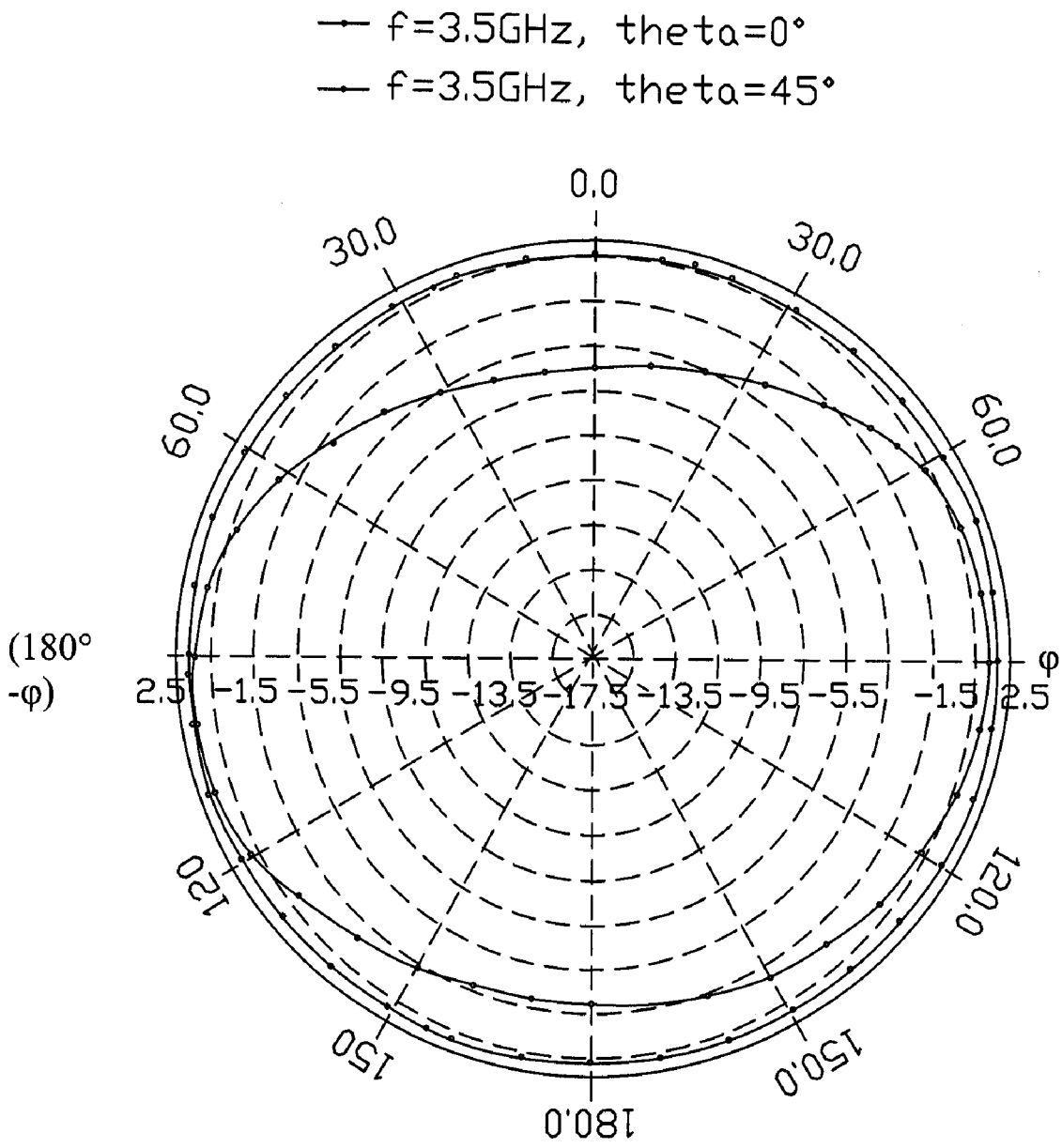

FIG. 9 is a graph showing return loss of the dual-band antenna 20.

As shown in FIG. 9, when the dual-band antenna 20 operates at frequencies of 2.5 GHz and 3.5 GHz, the return loss of the dual-band antenna 20 is less than −10 dB.

FIG. 10 through FIG. 13 are test charts showing radiation patterns when the dual-band antenna 20 operates at frequencies of 2.5 GHz and 3.5 GHz.

As shown in FIG. 10 through FIG. 13, when the dual-band antenna 20 operates at frequencies of 2.5 GHz and 3.5 GHz, all of the radiation patterns of the dual-band antenna 20 are substantially omni-directional.

The dual-band antennas 10, 20 provided in FIG. 1 and FIG. 8 employ the first radiators 140, 240, which are operated at a frequency of 2.5 GHz, and the second radiators 160, 260, which are operated at a frequency of 3.5 GHz, thereby, the dual-band antennas 10, 20 can be used for the two operating frequencies of the IEEE 802.16 standard. Furthermore, the length of the second grounded portion 190 is greater than that of the first grounded portion 180, thereby, when the dual-band antennas 10, 20 are operated at frequencies of 2.5 GHz and 3.5 GHz, the return losses of the dual-band antenna 10, 20, are less than −10 dB. In addition, the dual-band antenna 10 has a compact size by employing the notches 400, 401, 402.

Although various embodiments have been described above, the structures of the dual-band antennas 10, 20 should not be construed to be limited for use in respect of IEEE 802.16 standard only. When the size and/or shape of the dual-band antennas 10, 20 are changed or configured appropriately, the dual-band antennas 10, 20 can function according to any of various desired communication standards or ranges. Further, in general, the breadth and scope of the invention should not be limited by the above-described exemplary embodiments, but should be defined only in accordance with the following claims and their equivalents.

What is claimed is:

1. A dual-band antenna, printed on a substrate for transceiving electromagnetic signals, comprising:

a transmission portion for feeding the electromagnetic signals;

a first radiator electronically connected to the transmission portion, for transceiving electromagnetic signals with a first frequency;

a second radiator electronically connected to the transmission portion, for transceiving electromagnetic signals with a second frequency;

a first grounded portion disposed on a first surface of the substrate; and a second grounded portion disposed on a second surface of the substrate;

wherein a length of the second grounded portion is greater than that of the first grounded portion along the transmission portion, the second radiator comprises a first radiating portion electronically connected to the first radiator and the transmission portion, and the first radiating portion is parallel to the first radiator.

2. The dual-band antenna as recited in claim 1, wherein the transmission portion, the first radiator, and the second radiator are disposed on the first surface of the substrate.

3. The dual-band antenna as recited in claim 1, wherein the first grounded portion is disposed alongside the transmission portion.

4. The dual-band antenna as recited in claim 1, wherein a length of the first radiator is less than that of the second radiator.

5. The dual-band antenna as recited in claim 4, wherein the first radiator operates at a higher frequency than that of the second radiator.

6. The dual-band antenna as recited in claim 1, wherein the first radiator comprises at least one notch.

7. The dual-band antenna as recited in claim 1, wherein the second radiator comprises at least one notch.

8. The dual-band antenna as recited in claim 1, wherein the second radiator further comprises a second radiating portion perpendicular to the first radiating portion.

9. An antenna assembly, comprising:

a substrate;

a transmission portion for feeding the electromagnetic signals disposed on the substrate;

a first radiator electronically connected to the transmission portion, for transceiving electromagnetic signals with a first frequency; and a second radiator electronically connected to the transmission portion, for transceiving electromagnetic signals with a second frequency;

wherein the second radiator comprises a first radiating portion electronically connected to the first radiator and the transmission portion and a second radiating portion perpendicular to the first radiating portion.

10. The antenna assembly as recited in claim 9, wherein the transmission portion, the first radiator, and the second radiator are disposed on the first surface of the substrate.

11. The antenna assembly as recited in claim 9, wherein the first grounded portion is disposed alongside the transmission portion.

12. The antenna assembly as recited in claim 9, wherein a length of the first radiator is less than that of the second radiator.

13. The antenna assembly as recited in claim 9, wherein the first radiator comprises at least one notch.

14. The antenna assembly as recited in claim 9, wherein the second radiator comprises at least one notch.

15. The antenna assembly as recited in claim 9, further comprising a first grounded portion disposed on one surface of the substrate, and a second grounded portion disposed on another surface of the substrate, a length of the second grounded portion being greater than that of the first grounded portion along the transmission portion.

16. The antenna assembly as recited in claim 9, wherein the first radiating portion to the first radiator.

17. An antenna assembly, comprising:

a substrate; and an antenna disposed on said substrate, comprising a transmission portion for feeding electromagnetic signals in said antenna, a first radiator electrically connectable with one end of said transmission portion for transceiving said electromagnetic signals of said transmission portion with a first frequency, and a second radiator electrically connectable with said one end of said transmission portion for transceiving said electromagnetic signals of said transmission portion with a second frequency different from said first frequency; wherein said first and second radiators extends side by side along an extension direction away from said one end of said transmission portion, and a distance between said first and second radiators is substantially same as a width of said transmission portion.

18. The antenna assembly as recited in claim 17, further comprising a first grounded portion disposed beside said transmission portion on a first surface of said substrate same as said transmission portion, and a second grounded portion disposed on a second surface of said substrate opposite to said first surface, a length of said second grounded portion extending along a direction parallel to said transmission portion being greater than a length of said first grounded portion extending along said direction.

19. The antenna assembly as recited in claim 17, wherein said second radiator comprises a first radiating portion electrically connectable to said one end of said transmission portion and extending side by side along with said first radiator.

20. The antenna assembly as recited in claim 19, wherein said second radiator further comprises a second radiating portion perpendicular to said first radiating portion.

* * * * *